US009376175B1

(12) United States Patent
Karafiath et al.

(10) Patent No.: US 9,376,175 B1
(45) Date of Patent: Jun. 28, 2016

(54) WATER VESSEL WITH INTEGRATED BUOYANCY BULB AND STERN RAMP

(71) Applicants: Gabor Karafiath, Silver Spring, MD (US); John Fishback, Andover, MA (US)

(72) Inventors: Gabor Karafiath, Silver Spring, MD (US); John Fishback, Andover, MA (US)

(73) Assignee: The United States of America as represented by the Secretary of The Navy, Washington, DC (US)

( * ) Notice: Subject to any disclaimer, the term of this patent is extended or adjusted under 35 U.S.C. 154(b) by 18 days.

(21) Appl. No.: 14/267,025

(22) Filed: May 1, 2014

(51) Int. Cl.
*B63B 27/00* (2006.01)
*B63B 25/00* (2006.01)
*B63B 27/14* (2006.01)

(52) U.S. Cl.
CPC ..... *B63B 27/00* (2013.01); *B63B 25/008* (2013.01); *B63B 27/143* (2013.01)

(58) Field of Classification Search
CPC .... B63B 27/143; B63B 27/145; B63B 27/00; E01D 15/22
USPC ..... 14/69.5, 71.1, 71.3, 71.5, 72.5; 114/259, 362
See application file for complete search history.

(56) References Cited

U.S. PATENT DOCUMENTS

| | | | | | |
|---|---|---|---|---|---|
| 2,970,705 | A * | 2/1961 | Witt, Jr. | B63B 25/20 | 414/140.1 |
| 3,411,169 | A * | 11/1968 | Guerke | B63B 27/143 | 114/260 |
| 3,565,029 | A * | 2/1971 | Jan Arie Smit | B63B 1/08 | 114/57 |
| 3,596,623 | A * | 8/1971 | Frankel | B63B 27/143 | 114/259 |
| 3,879,784 | A | 4/1975 | Kummerman | | |
| 4,020,954 | A | 5/1977 | Vulovic | | |
| 4,039,163 | A | 8/1977 | Shorey | | |
| 4,441,449 | A | 4/1984 | Biaggi | | |
| 6,223,669 | B1 * | 5/2001 | Bowden | B63B 3/04 | 114/65 R |
| 6,536,363 | B1 | 3/2003 | Carlberg | | |
| 7,255,057 | B2 | 8/2007 | Wright | | |
| 7,296,528 | B1 | 11/2007 | Doyle et al. | | |
| 8,413,280 | B2 | 4/2013 | Goin et al. | | |
| 2003/0213072 | A1 * | 11/2003 | Myrick | B60P 1/43 | 14/69.5 |

* cited by examiner

*Primary Examiner* — Andrew Polay
(74) *Attorney, Agent, or Firm* — Dave A. Ghatt

(57) ABSTRACT

An apparatus for transferring assets to and from a water vessel. A water vessel having an integrated buoyancy bulb and stern ramp for transferring, launching and recovering assets such as wheeled or tracked amphibious vehicles. The integrated buoyancy bulb and stern ramp is configurable into different orientations to accommodate for different operational requirements, such as ship-to-water transfers, ship-to-ship transfers, or ship-to-dock transfers. The integrated buoyancy bulb and stern ramp is also configurable into a stowage orientation in which the ramp is folded and stored when not deployed.

7 Claims, 5 Drawing Sheets

Figure 2C
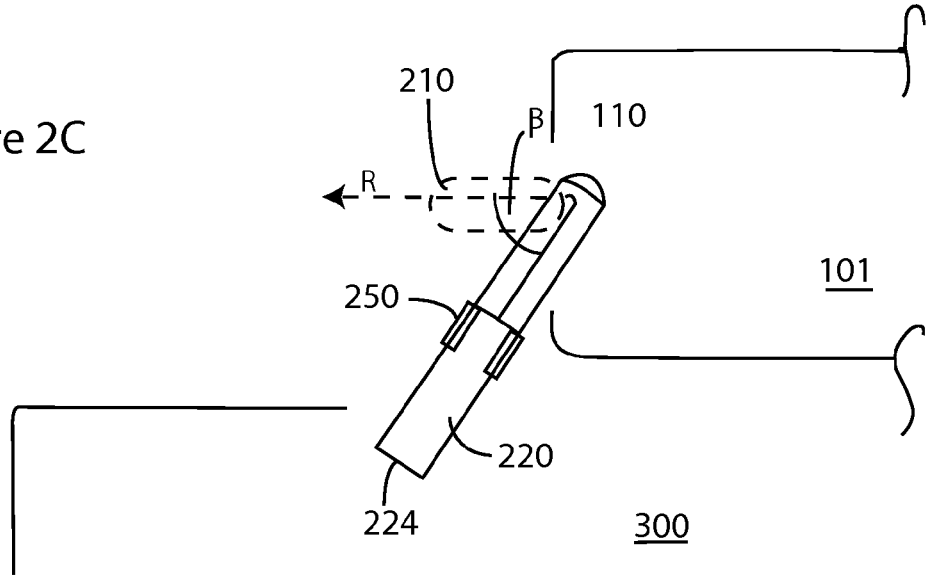
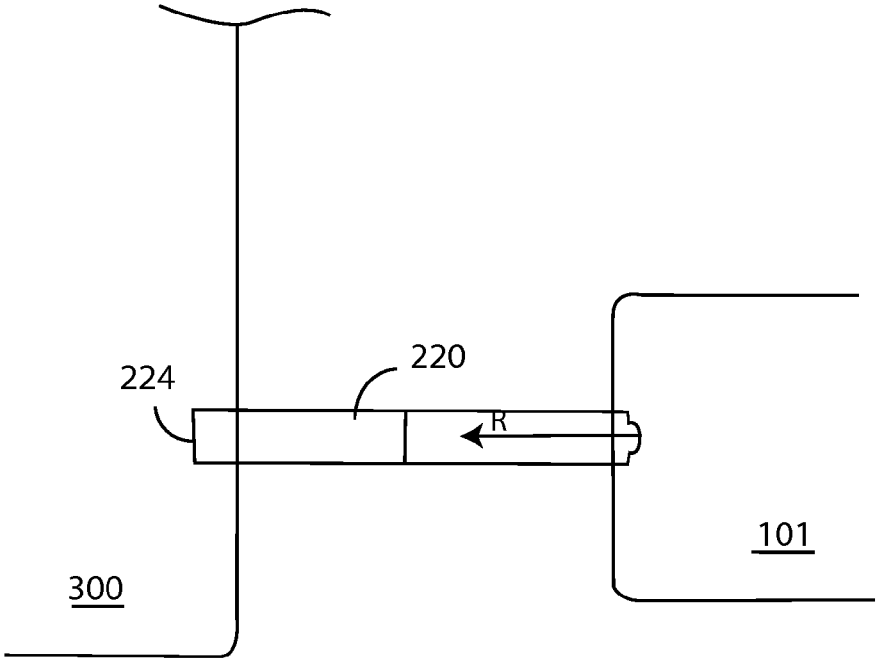
Figure 2D

WATER VESSEL WITH INTEGRATED BUOYANCY BULB AND STERN RAMP

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to an apparatus for transferring assets to and from a water vessel, more particularly, a water vessel having an integrated buoyancy bulb and stern ramp for transferring, launching and recovering assets such as wheeled or tracked amphibious vehicles, air-cushion vehicles, or like vehicles, the integrated buoyancy bulb and stern ramp configurable into different orientations to accommodate for different operational requirements.

BACKGROUND

Assets such as wheeled or tracked amphibious vehicles or air cushioned vehicles are routinely launched and recovered from water vessels. These assets are also routinely transferred to and from sea-bases or docks to water vessels. Ramps are employed to facilitate the transfer of assets as outlined above. A simple ramp may be a plank of a desired material that is connected to a deck of the water vessel. The ramp is positioned to extend from its water vessel to another vessel, a dock, or the open water.

There is always a need to increase the capabilities and functionality of ramps. More particularly, there is always a need to increase the ease, simplicity and efficiency of using a ramp. Additionally there is always a need to improve multi-functional capabilities of ramps that allows them to operate in various different asset-transfer scenarios. With increased multifunctional capabilities there is also a need for increased stability which also improves the safety associated with the use of the ramp. Thus it is desired to have a ramp that operates with increased ease, simplicity, and efficiency that has multifunctional capabilities enabling ship-to-sea, ship-to-ship, or other cargo transfer scenarios.

SUMMARY

In one aspect, the invention is a water vessel having an integrated buoyancy bulb and stern ramp. In this aspect, the water vessel has a hull having a bow, a stern, and a deck at the stern end of the hull. The integrated buoyancy bulb and stern ramp assembly having a bulb attached at the stern end of the hull for providing an upward force F at the stern of the hull. According to the invention, the integrated buoyancy bulb and stern ramp includes a ramp that is configurable into a plurality of orientations, including a stowage orientation, a water-based launch and recovery orientation, and a ship-to-ship/dock transfer orientation. The ramp has a top edge defining a top edge of the ramp, a bottom edge defining a bottom edge and a free end of the ramp. The ramp also includes a folding axis between the top edge and the bottom edge defining an axis about which the ramp folds. The ramp also has a first lateral edge defining a first outer edge of the ramp, and a second lateral edge defining a second outer edge of the ramp, wherein each of the first and second lateral edges extend from the top edge portion to the bottom edge portion. The ramp further includes a bottom segment extending from the bottom edge to the folding axis, and a top segment extending from the top edge to the folding axis. In this aspect, the integrated buoyancy bulb and stern ramp further includes a slidably mounted buoyancy float slidable along the ramp between a first location at about the bottom edge and a plurality of other locations along the bottom segment of the ramp.

BRIEF DESCRIPTION OF THE DRAWINGS

Other features will be apparent from the description, the drawings, and the claims.

FIG. 2C is an exemplary top view of an integrated buoyancy bulb and stern ramp attached to the stern of a water vessel, with the ramp in a ship-to-ship/dock transfer orientation, according to an embodiment of the invention FIG. 2D is an exemplary top view of an integrated buoyancy bulb and stern ramp attached to the stern of a water vessel, with the ramp in a head-on ship-to-ship/dock transfer orientation, according to an embodiment of the invention.

DETAILED DESCRIPTION

Figure 1:
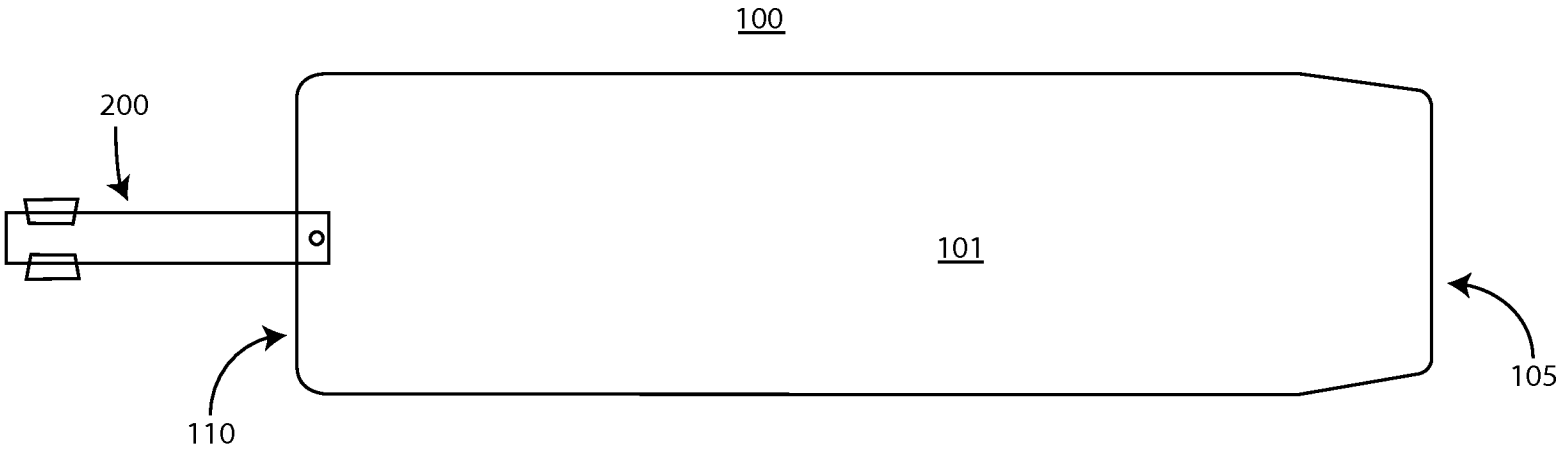
FIG. 1 is an exemplary top view of a water vessel having an integrated buoyancy bulb and stern ramp, according to an embodiment of the invention.

FIG. 1 is an exemplary top view of a water vessel 100 having an integrated buoyancy bulb and stern ramp assembly 200, according to an embodiment of the invention. FIG. 1 shows the water vessel 100 having a hull 101. The water vessel 100 may be a vessel such as a Joint High Speed Vessel (JHSV) or a vessel of similar size. FIG. 1 shows the hull 101 having a bow 105 and a stern 110. FIG. 1 shows the integrated buoyancy bulb and stern ramp assembly 200 at the stern 110. FIG. 1 also shows the integrated buoyancy bulb and stern ramp assembly 200 being centrally located at the stern 110. It should be noted that the integrated buoyancy bulb and stern ramp assembly 200 may also be offset either portside or starboard, if desired.

As outlined below, the water vessel 100 and the integrated buoyancy bulb and stern ramp assembly 200 may be used for transferring assets in a variety of asset-transfer scenarios. The assets may be wheeled or tracked amphibious vehicles or air-cushioned vehicles. It should be noted that air-cushioned vehicles as referred to regarding the instant invention, refers to smaller lightweight vehicles. According to a particular embodiment, the assets may be expeditionary fighting vehicles (EFVs) or assault amphibious vehicles (AAVs). The integrated buoyancy bulb and stern ramp assembly 200 is configurable to operate in the different asset-transfer scenarios. Depending on the orientation of the integrated buoyancy bulb and stern ramp assembly 200, and the asset-transfer scenario, the assets are launched, recovered or transferred by being powered along the surface of the ramp.

In addition to providing the physical ability to transfer assets, the integrated buoyancy bulb and stern ramp assembly 200 is designed to that it does not adversely affect the hydrodynamics of the water vessel 100. Typically, the addition of a large structure, such as a ramp, would have hydrodynamic drawbacks due to its size and the accompanying water resistance, affecting the top-end speed of the vessel. However, as outlined below, the integrated buoyancy bulb and stern ramp assembly 200, particularly the bulb portion, contributes to the hydrodynamic efficiency of the water vessel 100.

Figure 2A:
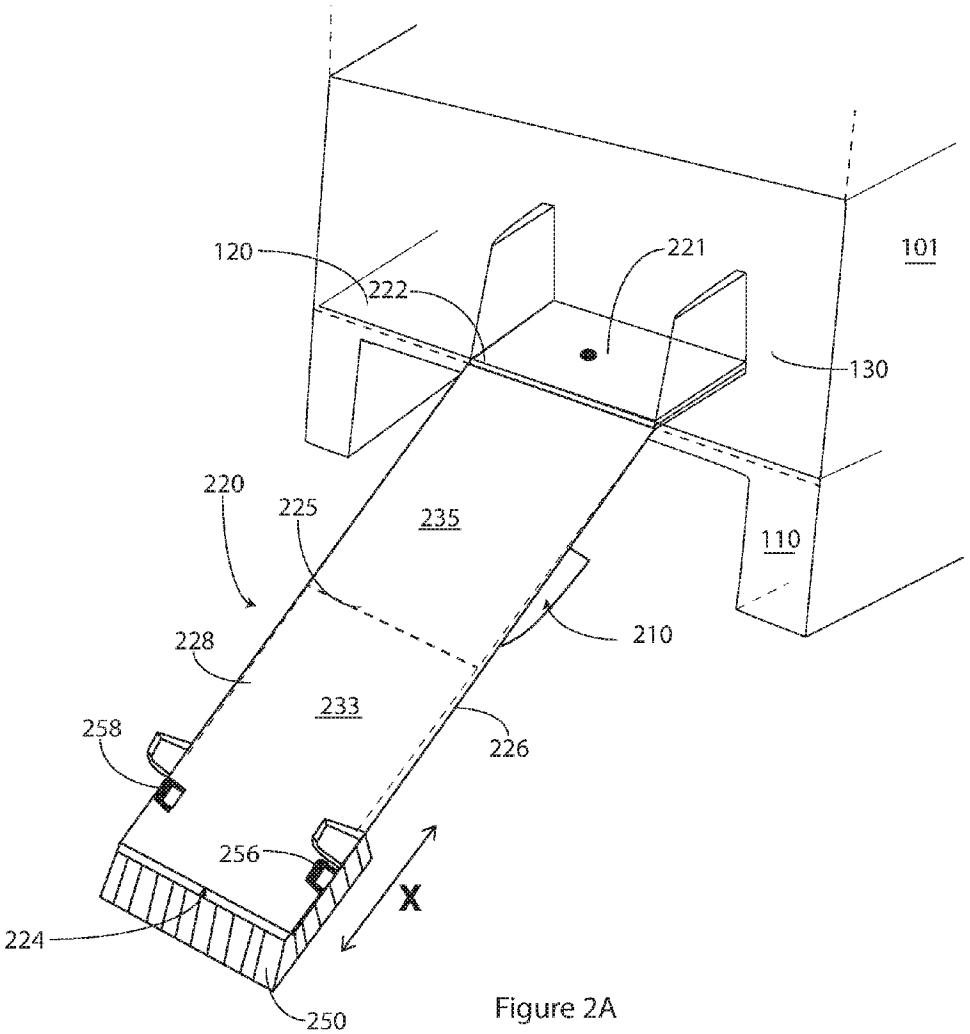
FIG. 2A is an exemplary perspective view of an integrated buoyancy bulb and stern ramp attached to the stern of a water vessel, according to an embodiment of the invention.

FIG. 2A is an exemplary perspective view of the integrated buoyancy bulb and stern ramp assembly 200 attached to the stern 110 of the hull 101, according to an embodiment of the invention. As shown the integrated buoyancy bulb and stern ramp 200 includes a bulb 210 attached to the stern 110. Because the bulb 210 is also positioned in the water, the bulb 210 provides and upward force F, thereby supporting the stern end of the hull 101. In addition to providing the beneficial upward force F, as stated above, the bulb 210 contributes to the hydrodynamic efficiency of the water vessel 100. Although the bulb 210 increases the wetted surface and frictional resistance, the shape and positioning of the bulb 210 also decreases wave-making. This contribution to decreased wave-making offsets the adverse effects of resistance, essentially resulting in maintaining the desired hydrodynamic efficiency of the vessel 100.

FIG. 2A also shows the integrated buoyancy bulb and stern ramp assembly 200 also includes a ramp 220. The ramp is attached at a deck 120 at the stern 110. According to an embodiment of the invention the vessel 100 such as a Joint High Speed Vessel (JHSV) or a vessel of similar size having multiple decks. The deck 120 may be preferably the lowest deck of the multiple decks. As outlined below, the ramp 220 may incorporate an assembly of connectors that allows for the adjustment of the angle of inclination of the ramp 220, as well as pivotal adjustability about a vertical axis, as outlined below. It should be noted that although FIG. 2A depicts a multi-deck vessel 100, it is conceivable that the vessel 100 is a single-deck vessel employing an integrated buoyancy bulb and stern ramp assembly 200 as shown, provided that the single-deck is at an appropriate height.

The ramp 220 may be attached to the deck 120 via a connection plate 221. As outlined below, with respect to FIG. 2C, the connection plate 221 may be journaled to pivot at an angle of rotation with respect to the astern direction. This motion pivots the entire ramp. The connection plate 221 may be journaled on a bearing facilitating the pivotal motion with respect to the astern direction. FIG. 2A also shows pillars 130, which may be positioned on the connection plate 221. As outlined below, the pillars 130 are mounted to rotate along with the ramp 220.

As shown, the ramp 220 has a top edge 222 defining the top edge of the ramp 220 and a bottom edge 224 defining the bottom edge and a free end of the ramp 220. FIG. 2A also shows a folding axis 225 between the top edge 222 and the bottom edge 224, defining an axis about which the ramp 200 folds. Known connectors such as hinges may be employed along the folding axis 225 to facilitate the folding function of the ramp 220, which is further outlined below.

FIG. 2A also shows the ramp 220 having a first lateral edge defining a first outer edge of the ramp 226, and a second lateral edge 228 portion defining a second outer edge of the ramp 220. The first and second lateral edges (226, 228) extend from the top edge portion to the bottom edge portion. As shown the folding axis 225 divides the ramp 220 into two segments. A bottom segment 233 extends from the bottom edge 224 to the folding axis 225, and a top segment 235 extends from the top edge 222 to the folding axis 225. As outlined below, when the ramp 220 folds, it folds up about the folding axis 225, bringing the bottom segment 233 and the top segment 235 adjacent to each other in a back-to-back relationship.

FIG. 2A shows a slidably mounted buoyancy float 250. The buoyancy float 250 is slidable in direction X along the ramp 220 between a first location at about the bottom edge/free end 224 and a plurality of other locations along the bottom segment 233 of the ramp 220. As outlined below, the slidably mounted buoyancy float 250 is movable in the X direction, and it's location on the ramp 220 depends on the particular configuration of the ramp 220.

According to an embodiment of the invention, the buoyancy float 250 has a first gripper arm 256 and a second gripper arm 258. As shown, the first gripper arm 256 wraps around the first lateral edge 226 of the ramp 220, and the second gripper arm 258 wraps around the second lateral edge 228 of the ramp 220. Because of the manner in which the first and second gripper arms (256, 258) wrap around the respective first and second lateral edges (226, 228), the buoyancy float is slidably maintained on the ramp 220. The first and second gripper arms (256, 258) facilitate the sliding along the ramp 220 and also the locking of the ramp at a desired location. Known sliding and locking means may be employed to facilitate these functions. For example, the first and second gripper arms (256, 258) may be made form a material that slides along the ramp, but creates a strong enough frictional force with the ramp 220 so that the buoyancy float is stationary when it is positioned in a desired location along the ramp. Alternatively, the gripper arms may include locking devices that press down on the ramp to lock buoyancy float 250 in a desired location. Alternatively, the gripper arms (256, 258) may have wheels that allow the buoyancy float 250 to roll along the ramp to any desired location. The wheels may include a locking mechanism that locks them in position when the buoyancy float is moved to a desired location.

According to the invention, the ramp 220 is configurable into a plurality of orientations. These different orientations include a water-based launch and recovery orientation, a ship-to-ship/dock transfer orientation, and a stowage orientation. The former two orientations allow the ramp to perform properly in different asset-transfer scenarios. The stowage orientation defines an orientation in which the ramp 220 may be safely stored when the ramp 220 is not being deployed. In the illustration of FIG. 2A, the ramp is configured in a water-based launch and recovery orientation for transferring assets from the open water to the water vessel 100 and vice versa. As stated above, according to an embodiment of the invention, the assets may be wheeled or tracked, which in the FIG. 2A orientation may be self-powered up and down the ramp 220 during launching and recovery operations. The assets may also be air-cushioned vehicles, which as stated above are smaller lightweight air-cushioned vehicles with dimensions that allow them to be moved up and down the ramp 220. Typically, because of the slope of the ramp, air-cushioned vehicles of this type would require assistance when being moved up the ramp 220.

Figure 2B:
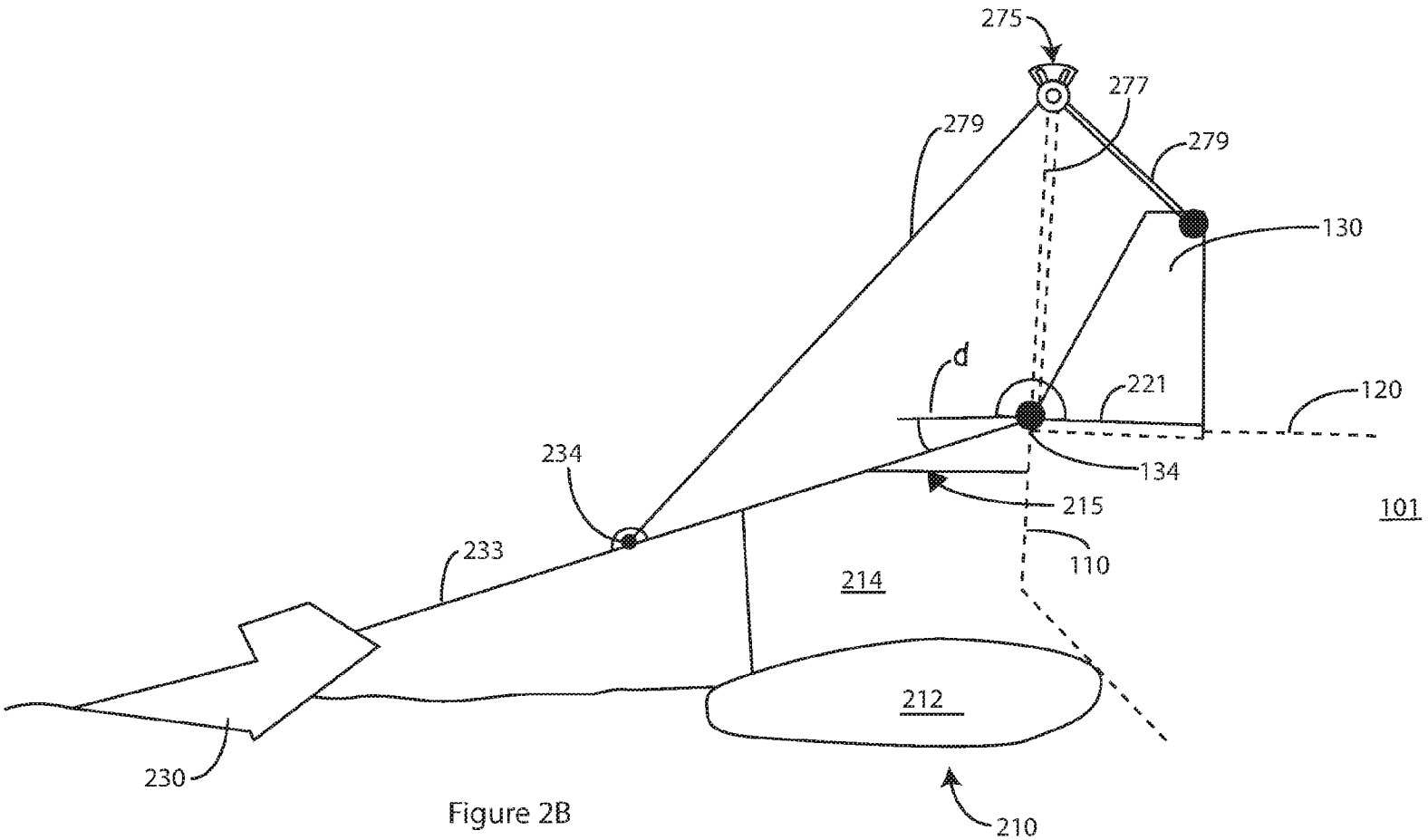
FIG. 2B is an exemplary side view of an integrated buoyancy bulb and stern ramp attached to the stern of a water vessel, with the ramp in a water-based launch and recovery orientation, according to an embodiment of the invention.

FIG. 2B provides a side view of the ramp 220 in a water-based launch and recovery orientation, highlighting additional features of the integrated buoyancy bulb and stern ramp assembly 200. In the water-based launch and recovery orientation, the water vessel and the integrated buoyancy bulb and stern ramp assembly 200 are set up to transfer assets up the ramp from the water to the water vessel 100 or down the ramp from the water vessel 100 to the open water.

FIG. 2B shows the assembly 200 having the ramp 220, which is hingedly attached at or about the ramp top edge 222 to the stern 110 of the hull 101. Because the stern 110 and the bulb 210 are in different planes, the stern 110 is shown in dotted lines. A known attachment assembly 134, such as hinges or the like, may be used to attach the ramp 220 to the deck 120 of the vessel hull 101. According to an embodiment of the invention, the ramp 220 is connected to the deck 120 via the connection plate 221, which is positioned on the deck 120. Although FIG. 2B shows only one deck 120, as outlined above, the deck 120 may be preferably the lowest deck of the multiple decks. According to this embodiment, the attachment assembly 134 hingedly connects the ramp 220 to the connection plate 221. As shown, in the water-based launch and recovery orientation, the ramp 220 slopes up at an angle of inclination $\alpha$ with respect to the horizontal. As outlined below, the angle of inclination $\alpha$ is defined by the operation. In the water-based launch and recovery orientation shown in FIG. 2B, there is a downward inclination.

The attachment assembly 134, which may be a hinge, is used to adjust the angle of inclination $\alpha$ of the ramp 220. FIG. 2B also shows attachment assembly 234, which is located along the folding axis 225 for folding the bottom and top segments (233, 235). The attachment assembly 234 may for example be hinges extending along the folding axis 225. It should be noted that in the FIG. 2B orientation, the bottom segment 233 is aligned with the top segment 235 forming a single continuous linear upper surface.

Figure 2E:
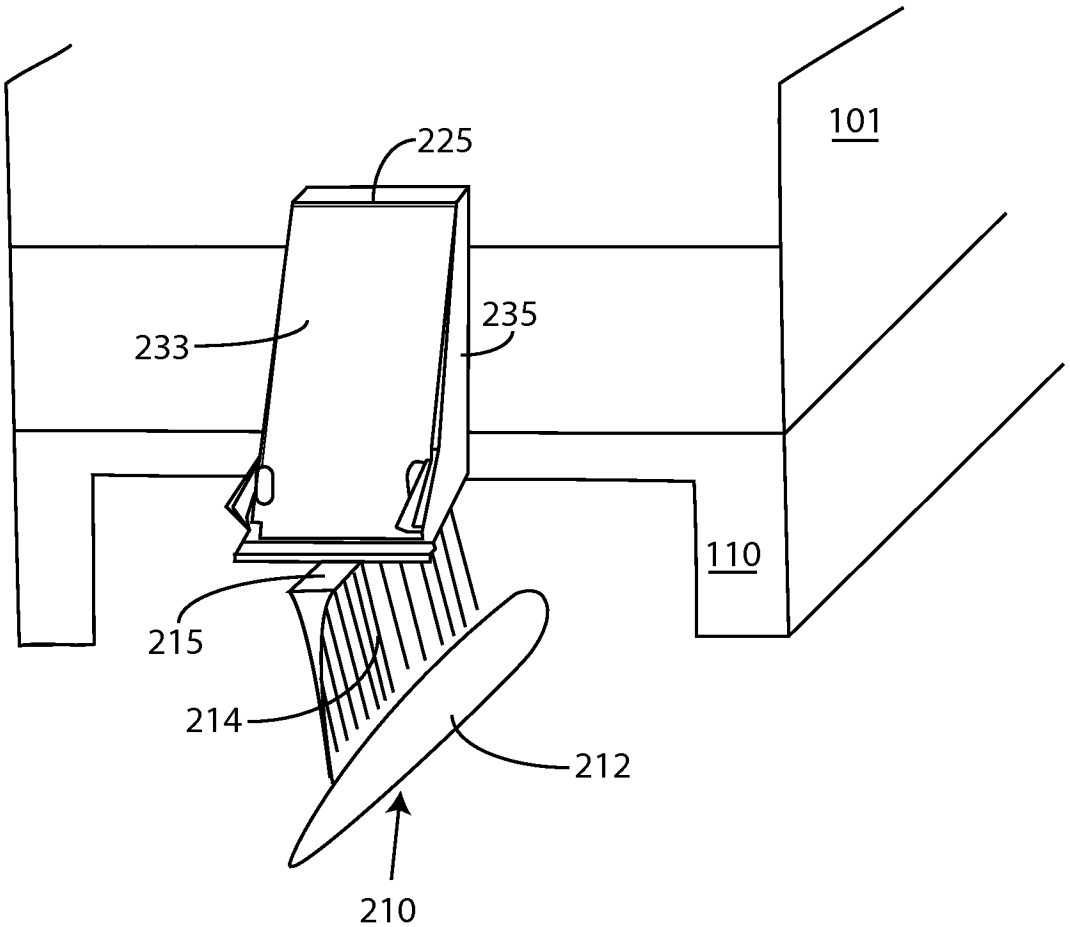
FIG. 2E is an exemplary perspective view of an integrated buoyancy bulb and stern ramp attached to the stern of a water vessel, with the ramp in a stowage orientation, according to an embodiment of the invention

FIG. 2B shows the slidably mounted buoyancy float 250 at a first location at about the bottom edge/free end 224 (not shown in FIG. 2B, but shown in FIG. 2A) of the ramp 220. At this position, the buoyancy float 250 supports the free end 224 (shown in FIG. 2A) of the ramp on the open water 201, steadying the ramp for launch and recovery operations. Also shown is the bulb 210 attached at the stern 110 of the hull 101. As shown, the bulb 210 includes a substantially cylindrical base 212. According to an embodiment of the invention, the substantially cylindrical base 212 has a conical shape. The bulb 210 also includes a support wall 214 extending upwards from the substantially cylindrical base 212. This structure of the support wall 214 and the substantially cylindrical base 212 having a conical shape is also shown in FIG. 2E.

In the water-based launch and recovery orientation, because the ramp 220 is at an angle of inclination $\alpha$, the ramp 220 is supported on the upper face 215 of the support wall 214. As shown, an under surface of the top segment 235 rests on the upper face 215 of support wall 214, which has a slight downward slope. Thus, when the ramp 220 is being used for launching and retrieving assets, the support wall 214 supports the ramp. As stated above, the assets may be wheeled or tracked amphibious vehicle, which are self-powered up and down the ramp during launching and recovery operations. The assets may also be air-cushioned vehicles as outlined above. As stated above, because of its location, the bulb 210 provides an upward force E at the stern 110, which provides additional stability during launching and recovery operations.

FIG. 2B also shows a hoisting assembly 275, mounted on the deck 120, and connected to the ramp 220. The hoisting assembly 275 as shown includes a support stanchions 277 and cables 279. The cables 279 are attached at the folding axis 225 of the ramp 220 at one end, and at the other end are attached at the top of the pillar 130. This arrangement enables the folding of the ramp 220, as outlined below. The hoisting assembly 275 is used to deploy the ramp 220, and supports the ramp 220 while it is being deployed. Once deployed, the ramp 220 is supported at its ends 222 and 224. Although not illustrated, the hoisting assembly 275 may include pulleys, winches, one or more motors, as well as other known elements.

FIG. 2C is an exemplary top view of the ramp 220 in a ship-to-ship/dock transfer orientation, according to an embodiment of the invention. The elements of the integrated buoyancy bulb and stern ramp assembly 200 are as outlined above with respect to FIGS. 2A and 2B. In this orientation, the water vessel 100 with the integrated buoyancy bulb and stern ramp assembly 200 is positioned to transfer assets between the water vessel 100 and another water vessel, or between the water vessel 100 and a dock. The orientation shown in FIG. 2C accommodates for scenarios in which the water vessel 100 pulls alongside another vessel or the dock in a side-by-side relationship. As outlined below, the ramp 220 is pivoted or slewed towards the other vessel or dock to facilitate the transfer.

As shown in FIG. 2C, in the ship-to-ship/dock transfer orientation, the ramp 220 is pivotally attached to the deck 120 at the stern 110 at an angle of rotation $\pm\beta$ with respect to the astern direction. The astern direction is represented by the direction line R. The rotation angle $\pm\beta$ indicates that the ramp 220 may be rotated in to the left or to the right of the direction line R. According to an embodiment of the invention, $0<\beta\leq 90$. Any known pivoting connectors may be used to facilitate the pivoting of the ramp. For example, the ramp 220 may include a connection plate 221 that may be journaled at the middle of the plate 221 to facilitate this pivoting motion. Alternatively, the plate 221 may include a pair of opposing slots through which deck bolts extend. The slots may slide about the bolts in a known manner resulting in the pivoting motion of the ramp 220, in a manner as outlined in U.S. Pat. No. 8,413,280, which is herein incorporated by reference. Alternatively, the plate 221 may be mounted on rails in the deck, which also allow the ramp 220 to pivot as outlined in U.S. Pat. No. 3,879,784, which is hereby incorporated by reference. One or more motors may be used to power the pivoting movement of the ramp 220. Due to the arrangement at the connection plate 221, when the ramp 220 rotates along with the plate 221 and the pillars 130 to which the cables 279 are attached.

As shown in FIG. 2C, the ramp 220 is pivoted at a rotation angle $\pm\beta$, and extends over to another vessel or deck represented by reference numeral 300. The free end 224 of the ramp 220 rests on the deck of the other water vessel or a dock 300. As shown, the buoyancy float 250 is now positioned at a central area of the ramp 220 at about the folding axis 225, where it does not obstruct the transfer of assets.

Referring to FIG. 2C, in operation the water vessel 100 pulls alongside the water vessel or dock 300. The ramp is pivoted at a rotation angle $\pm\beta$ with the free end of the ramp 220 resting on the vessel or dock 300. In this orientation, the ramp 220 may not be inclined. Thus, the angle of inclination $\alpha$ may be about 0°. However, as stated above, the angle of inclination $\alpha$ is defined by the operation. Thus, in the ship-to-ship/dock transfer orientation shown in FIG. 2C, the inclination $\alpha$ is determined by the relative heights of the ends of the ramp 222 and 224. Thus if the vessel or dock 300 is vertically lower than the water vessel 100, the ramp 220 slopes downwards. Alternatively, if the vessel or dock 300 is vertically higher than the water vessel 100, the ramp 220 slopes upwards.

When the ramp is in the position shown in FIG. 2C, the transfer of assets may take place. It should be noted that in the FIG. 2C orientation, regardless of the angle of inclination $\alpha$ or the rotation angle $\pm\beta$, the bottom segment 233 is aligned with the top segment 235 forming a single continuous upper surface. Assets may be transferred along this surface from the water vessel 100 to the other vessel or dock 300, or assets may be transferred from the dock/vessel 300 to the water vessel 100. As shown, in this orientation, the buoyancy float 250 is moved to the central area where it does not hamper operations. The assets may be wheeled or tracked amphibious vehicles, which may be driven back and forth across the ramp. The assets may also be air-cushioned vehicles as described above. According to an embodiment of the invention, the vessel 300 may be a mobile landing platform (MLP).

As opposed to the side-by-side relationship shown in FIG. 2C for transferring assets between the water vessel 100 and another vessel or dock 300, it is within the prevue of this invention for the asset-transfer to be carried out with the water vessel 100 in a head-on orientation with respect to the other vessel or dock 300. FIG. 2D is an exemplary top view of an integrated buoyancy bulb and stern ramp attached to the stern of a water vessel, with the ramp in a head-on ship-to-ship/dock transfer orientation, according to an embodiment of the invention. FIG. 2D illustrates an asset-transfer scenario similar to that of FIG. 2C, i.e., the water vessel 100 with the integrated buoyancy bulb and stern ramp assembly 200 is positioned to transfer assets between the water vessel 100 and another water vessel or dock 300. The orientation shown in FIG. 2D accommodates for scenarios in which the water vessel 100 is positioned head-on with respect to the dock or the loading deck of the other vessel 300. According to this embodiment, the ramp 220 is not pivoted or slewed, so the rotation angle β is about 0°. As outlined above, the assets may be wheeled or tracked amphibious vehicles, or air-cushioned vehicles. The vessel 300 may be an MLP.

FIG. 2E is an exemplary perspective illustration of the ramp 220 in a stowage orientation, according to an embodiment of the invention. When not deployed, the ramp 220 may be stored in the position as shown in FIG. 2D. As shown, the top segment 235 and the bottom segment 233 are folded about the folding axis 225, so that they are both raised in a substantially vertical orientation. As shown, in the stowage orientation, the top segment 235 and the bottom segment 233 are adjacent to each other in a back-to-back relationship. In operation, the hoisting assembly 275 is used to raise the ramp 220 about the folding axis 225 into the stowage orientation. The hoisting assembly 275 performs the act of lifting the ramp 220 when the ramp 220 facing the astern direction, i.e., when the above-mentioned angle of rotation β is about equal to 0°.

In the stowage orientation, the folding axis 225 is vertically higher than all other parts of the ramp. Also, the buoyancy float 250 is located at or about the bottom edge 224 of the ramp 220. As shown, the buoyancy float 250 contacts and is supported on the upper face 215 of the support wall 214. By physically contacting and supporting the buoyancy float which is attached to the ramp 220, the bulb 210 provides stability to the ramp 220 in the stowed orientation.

What has been described and illustrated herein are preferred embodiments of the invention along with some variations. The terms, descriptions and figures used herein are set forth by way of illustration only and are not meant as limitations. For example, as illustrated, the integrated buoyancy bulb and stern ramp assembly 200 is centrally located at the stern 110. However, the integrated buoyancy bulb and stern ramp assembly 200 may also be offset either portside or starboard, if desired. Additionally, although the disclosure states that the ramp 220 is connected to an deck 120, there may be embodiments in which the hull 101 has multiple decks, and the ramp may be connected to any of the multiple decks, if desired. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A water vessel having an integrated buoyancy bulb and stern ramp, the water vessel comprising:
- a hull having:
  - a bow;
  - a stern; and
  - a deck at the stern end of the hull;
- an integrated buoyancy bulb and stern ramp assembly comprising:
  - a bulb attached at the stern end of the hull for providing an upward force F at the stern of the hull,
  - a ramp configurable into a plurality of orientations, including a stowage orientation,
  - a water-based launch and recovery orientation, and a ship-to-ship/dock transfer orientation, the ramp comprising:
    - a top edge defining a top edge of the ramp;
    - a bottom edge defining a bottom edge and a free end of the ramp;
    - a folding axis between the top edge and the bottom edge defining an axis about which the ramp folds;
    - a first lateral edge defining a first outer edge of the ramp;
    - a second lateral edge defining a second outer edge of the ramp, wherein each of the first and second lateral edges extend from the top edge portion to the bottom edge portion;
    - a bottom segment extending from the bottom edge to the folding axis;
    - a top segment extending from the top edge to the folding axis;
- the integrated buoyancy bulb and stern ramp further comprising:
  - a slidably mounted buoyancy float slidable along the ramp between a first location at about the bottom edge and a plurality of other locations along the bottom segment of the ramp, wherein the ramp is hingedly attached to the deck at the stern of the hull providing adjustability of an angle of inclination α of the ramp with respect to the horizontal, and wherein the ramp is also pivotally attached to the deck at the stern of the hull providing adjustability of an angle of rotation ±β with respect to the astern direction, about a vertical axis, wherein the angle of inclination α, the angle of rotation ±β, and the folding of the ramp define whether the ramp is in said stowage orientation, said water-based launch and recovery orientation, or said ship-to-ship/dock transfer orientation, and wherein the bulb comprises a substantially cylindrical base and a support wall extending upwards from the substantially cylindrical base, the support wall having an upper face wherein a surface of the ramp is supported on the upper face of the support wall when the ramp is deployed in said water-based launch or recovery orientation, and wherein the buoyancy float is supported on the support wall when the ramp is in said stowage orientation.

2. The water vessel of claim 1, wherein in said stowage orientation, the top segment and the bottom segment are folded about the folding axis so that each of the top segment and the bottom segment are in a substantially vertical orientation and are adjacent to each other in a back-to-back relationship, with the folding axis raised so that the folding axis is vertically higher than all other parts of the ramp, and wherein buoyancy float is located at or about the bottom edge of the ramp so that the buoyancy float contacts and is supported on the upper face of the support wall of the bulb, thereby providing stability to the ramp in said stowage orientation.

3. The water vessel of claim 2, wherein in said water-based launch and recovery orientation, the ramp is hinged so that the top segment of the ramp is angled downwards at an angle $\alpha$ with respect to a horizontal, and wherein the bottom segment of the ramp is aligned with the top segment of the ramp forming a single continuous upper surface, and wherein the buoyancy float is positioned at or about the bottom edge, thereby supporting the free end of the ramp on the water.

4. The water vessel of claim 3, wherein in said ship-to-ship/dock transfer orientation, the ramp is pivotally attached at an angle of rotation $\pm\beta$ with respect to said home orientation, wherein $0 \leq \beta \leq 90$, wherein the bottom segment of the ramp is aligned with the top segment of the ramp forming a single continuous upper surface, wherein the free end of the ramp rests on the deck of a second water vessel or a dock, and wherein the buoyancy bulb is positioned on the bottom segment at about the folding axis.

5. The water vessel of claim 4, wherein in said ship-to-ship/dock transfer orientation, the water vessel 100 is docked in a side-by-side relationship with one of a water vessel or dock, and the ramp is pivotally attached at an angle of rotation $\pm\beta$ with respect to said home orientation, wherein $0 < \beta \leq 90$.

6. The water vessel of claim 4, wherein in said ship-to-ship/dock transfer orientation, the water vessel 100 is docked in a head-on relationship with one of a water vessel or dock, and the ramp is pivotally attached at an angle of rotation $\pm\beta$ with respect to said home orientation, wherein $\beta$ is about 0°.

7. The water vessel of claim 6, wherein the buoyancy float includes a first gripper arm that wraps around the first lateral edge of the ramp, and a second gripper arm that wraps around the second lateral edge of the ramp, the first and second gripper arms slidably gripping the respective first and second lateral edges thereby keeping the buoyancy float attached to the ramp.

* * * * *